US006334482B2

(12) United States Patent
Berglund et al.

(10) Patent No.: US 6,334,482 B2
(45) **Date of Patent: *Jan. 1, 2002**

(54) HEAT EXCHANGER WITH TUBES SUSPENDED INTO A LOWER END PLATE ALLOWING THERMAL MOVEMENT OF THE TUBES

(75) Inventors: Göran Berglund, Sandviken; Ulf Eriksson, Göteborg, both of (SE)

(73) Assignee: Sandvik AB (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/449,522

(22) Filed: Nov. 29, 1999

Related U.S. Application Data

(63) Continuation-in-part of application No. PCT/SE98/00952, filed on May 28, 1998.

(30) Foreign Application Priority Data

May 28, 1997 (SE) ..... 9701998

(51) Int. Cl.[7] ..... F28F 7/00; F28F 13/00; F28F 9/18

(52) U.S. Cl. ..... 165/82; 165/162; 165/81; 165/135

(58) Field of Search ..... 165/81, 82, 83, 165/135, 158, 162

(56) References Cited

U.S. PATENT DOCUMENTS

| | | | | |
|---|---|---|---|---|
| 2,834,581 | A | 5/1958 | Schefels et al. | |
| 2,989,952 | A | 6/1961 | Riehl | |
| 3,263,747 | A | 8/1966 | McKay | |
| 3,602,296 | A | 8/1971 | Heyn | |
| 3,751,228 | A | 8/1973 | Semenov | 165/82 |
| 3,974,022 | A | 8/1976 | Lauro | |
| 3,992,169 | A | 11/1976 | Loudon | 138/112 |
| 4,360,057 | A | 11/1982 | Koump | 165/82 |
| 4,411,308 | A | 10/1983 | Koerdt et al. | 165/134.1 |
| 4,640,343 | A | 2/1987 | Dearden et al. | 165/70 |
| 4,753,457 | A | 6/1988 | Oda et al. | 285/47 |
| 5,079,267 | A | 1/1992 | Kao et al. | 518/704 |
| 5,866,083 | A | 2/1999 | Berglund et al. | |

FOREIGN PATENT DOCUMENTS

| | | | |
|---|---|---|---|
| AU | 191441 | 8/1957 | 165/82 |
| DE | 816 995 | 10/1951 | |
| EP | 0 246 486 | 11/1987 | |
| FR | 1178 105 | 5/1959 | |
| FR | 1 390 942 | 1/1965 | |
| JP | 60-120196 | 6/1985 | |
| SE | 510240 | 5/1999 | |
| WO | WO 95/22037 | 8/1995 | |

*Primary Examiner*—Ira S. Lazarus
*Assistant Examiner*—Tho Duong
(74) *Attorney, Agent, or Firm*—Burns, Doane, Swecker & Mathis, LLP

(57) ABSTRACT

A tube heat exchanger intended to be used for the production of carbon black, includes a cylindrical closed chamber having a plurality of tubes which extend through the entire, essentially cylindrically shaped chamber. Upper end of the tubes are attached to an upper end wall, preferably by welding, and hang down to a tube plate. The tube plate equipped with compensating devices to enable thermally induced expansions and contractions of the tubes to occur.

3 Claims, 5 Drawing Sheets

HEAT EXCHANGER WITH TUBES SUSPENDED INTO A LOWER END PLATE ALLOWING THERMAL MOVEMENT OF THE TUBES

This application is a continuation of U.S. application Ser. No. 09/449,522 filed on Nov. 29, 1999, which was a continuation-in-part of International Application No. PCT/SE98/00952, filed on May 28, 1998, which International Application was published by the International Bureau in English on Dec. 3, 1998.

BACKGROUND OF THE INVENTION

The present invention relates to a tube heat exchanger and a tube plate for supporting the tubes of a tube heat exchanger. Specifically the invention relates to a heat exchanger with vertical tubes of considerable lengths having weights which in combination with high temperature subject the tubes themselves and the tube plate to considerable stresses. This tube plate is particularly suitable for use in tube heat exchangers which produce carbon black.

Carbon black is the term used for the finely divided powder forms of carbon which are produced by incomplete combustion or thermic degradation of natural gas or mineral oil. Depending on the method of production, different types of carbon black arise, namely so called channel black, furnace black and pyrolysis black (also called thermal black). Furnace black is by far the most important form of carbon black and is used to a considerably larger extent than the other two. The present invention relates specifically to this type of carbon black, which in the present application is referred to simply as just"carbon black".

FIG. 1A illustrates a conventional plant for the production of carbon black (i.e. of the furnace black type). Incoming combustion air flows through a tube conduit 1 into the upper part of a tube heat exchanger 2, in which it is preheated before supporting the subsequent combustion of oil in the burner 9 and the combustion reactor 3. The thus preheated air is passed into the combustion chamber 10 via a conduit 5. Oil is added to said reactor via a tube conduit 4. The amount of air corresponds to about 50% of the stoichiometric amount of oxygen gas required for a complete combustion of the oil, whereby carbon black is formed. It is also possible to add water into the reactor 3, which has an impact on the quality of the final product. The mixture of the suspended carbon black in the consumed combustion air is led away from the top of the heat exchanger via a conduit 6, through a cooler 7 which is normally water cooled to a filter arrangement 8, conventionally equipped with textile bag filters. In this filter arrangement the carbon black is filtered off from the gas flow, which is then passed out through a non-return valve 16 for further purification in a plant 11, before it is exhausted into the ambient air via a chimney 12.

The construction of the conventional heat exchanger 2 may be more clearly seen in FIG. 1B. The heat exchanger is of the tube type, with a plurality of substantially vertical tubes 13 whose lower ends are supported on a tube plate 5A. The gases from the combustion process rise up the insides of these tubes, whereby they are cooled by the air that enters via the inlet 1 and passes outside the tubes 13 downwards towards the outlet 5, in the space enclosed by the outer jacket wall 14. In order to increase heat transfer, the air coming through the inlet 1 is subjected to a reciprocal movement by an arrangement of a plurality of mainly horizontal baffles 15. These are made of plates which extend across about ¾ of the diameter of the heat exchanger whereby each plate is provided with a plurality of holes for the receipt of the tubes 13. The temperature at the inlet 1 of the heat exchanger tubes 13 may be about 1000° and the air coming through conduit 1 may be heated to about 800°. These conditions result in utmost severe stresses for the materials in the heat exchanger. The part of the heat exchanger that is submitted to the highest mechanical stress is the lower part of the jacket and the tube plate 5A where the temperature may amount to 900°. Thus, with an internal pressure of approximately 1 bar at that temperature, a jacket wall diameter of about 2000 mm, tubes numbering between 50 and 150, plus a height of the tower of approximately 13 m, it can be easily understood that the tube plate must be able to withstand exceptionally large stresses, particularly since the tubes 13 rest with their entire weight on the tube plate. Furthermore, even the lower portions of the actual tubes 13 are exposed to heavy loads via their own weight in combination with the high temperatures. The tubes 13 have individual compensator devices placed at the top of each tube, the function of which is to off-load the thermally induced stresses in the tubes, as a result, for example of clogging.

An equivalent problem involving the actual outer jacket wall 14 has been solved as described in commonly-assigned Swedish Patent Application No. 9504344-4, corresponding to U.S. Pat. No. 5,866,083, the contents of which are hereby incorporated by reference. According to the invention, the heat exchanger includes a further jacket wall, which is substantially cylindrical and is placed inwards and mainly concentrically to the outer jacket wall so that at both ends open, mainly cylindrical spaces are formed in the gap between the two jacket walls, whereby the gas which flows in through the inlet passes through this space before coming into contact with the tubes of the heat exchanger. Occasionally the tube plate has failed to stand up to the heavy loads to which it has been exposed leading to very high repair costs.

Attempts have been made to cool the lower tube plate through a double bottom construction as shown in FIG. 2. In this design, a portion of the incoming air which enters through the inlet 1 is lead away in a vertical pipe 17 and flows down into a double-wall tube plate 18, which includes an upper thermally insulated wall 19 and a lower thermally insulated wall 20, so that a chamber (manifold) 21 is formed between the two walls. Air from the vertical pipe 17 flows into the manifold 21 and hence cools the tube plate, after which the air flows out through an exhaust pipe 22 and is returned to the heat exchanger. However this design has not proved to be sufficiently effective since it does not cool the tube plate adequately. Therefore it has been proposed that, in accordance with Swedish Patent Application 9603739-5, the manifold 21 be split up into a number of channels through the use of dividing walls, whereby each channel is provided with an inlet and an exhaust, and a number of heat exchange tubes pass through each channel. This has solved the problem of excessive temperatures in the base plate in a satisfactory manner, but the lower portions of the heat exchanger tubes are still very hot and can, for example, bend or buckle. It should be borne in mind that a 13 m long heat exchanger tube can weigh approximately 100 kg. Since the tube stands with its entire weight on the tube plate, the tube plate and the lower, very hot parts of the tubes are particularly heavily loaded. When a buckle is induced, stress on the tubes increases and the deformation process can accelerate.

OBJECTS AND SUMMARY OF THE INVENTION

A prime objective of the present invention is thus to produce a heat exchanger in which the lower parts of the tubes are protected from large loads.

A second objective of the invention in question is even to protect the lower tube plate from large loads.

These and other objectives have been successfully achieved in a surprisingly simple manner by designing the heat exchanger so as to include a substantially cylindrical, closed vessel which defines a space, and providing a horizontal support wall disposed adjacent an upper portion of the space. A plurality of tubes are affixed to the support wall and hang downwardly therefrom. A tube plate is situated adjacent a lower portion of the space. The tube plate includes upper and lower walls spaced vertically apart to form a chamber therebetween. Metallic bellows are disposed around respective tubes. Each bellows extends between the tube and the tube plate. The bellows are compressible and expandable to accommodate thermal expansion and contraction of the tubes.

BRIEF DESCRIPTION OF THE DRAWINGS

For illustrative but non-limiting purposes, preferred embodiments of the invention will now be described with reference to the appended drawings, in which.

DETAILED DESCRIPTION OF PREFERRED EMBODIMENTS OF THE INVENTION

Figure 3:
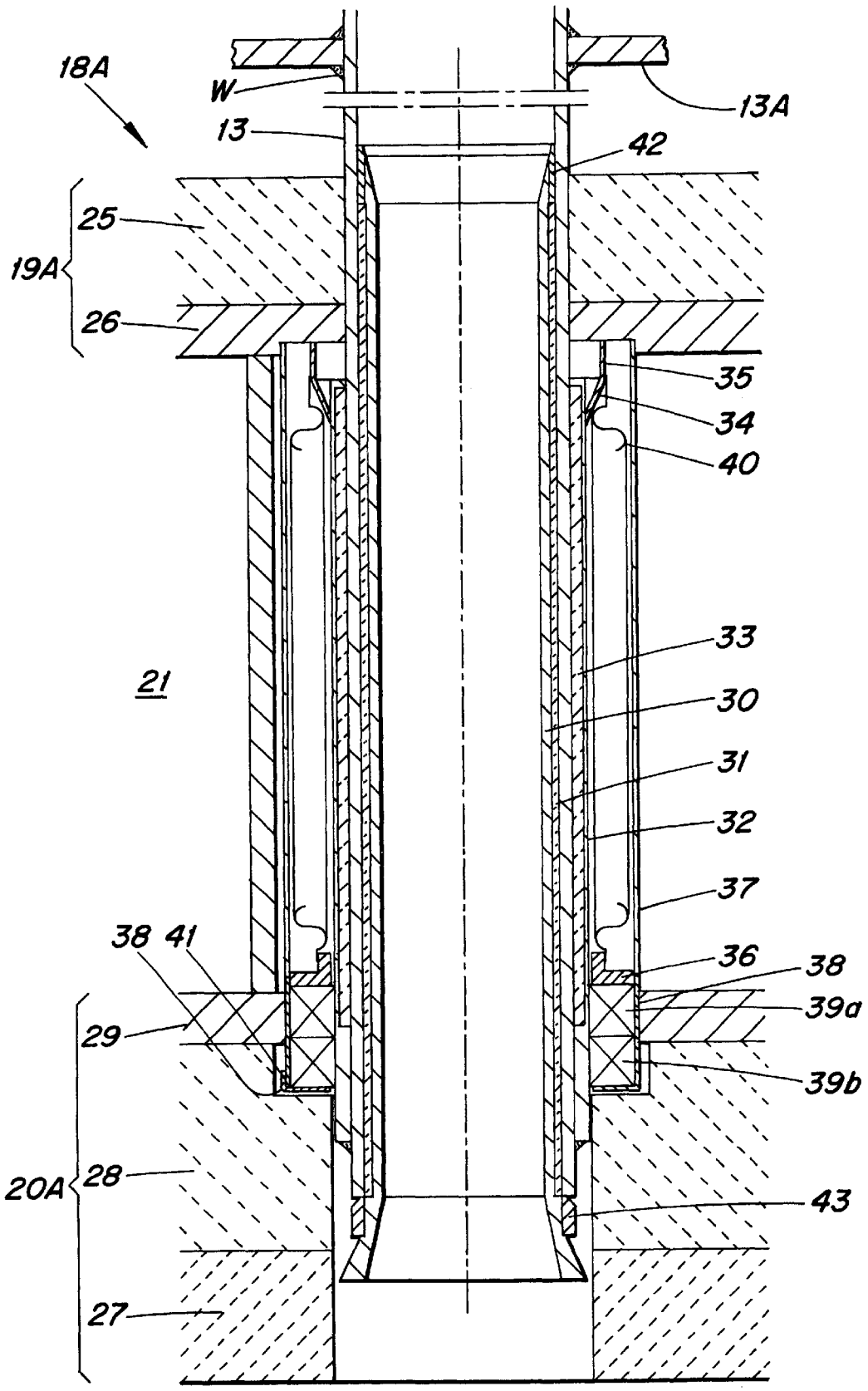
FIG. 3 shows a heat exchanger tube passing through a tube plate according to this invention, in a first embodiment.

FIG. 3 shows how the lower parts of heat exchanger tubes 13 pass through a double walled tube plate 18A in the lower region of the heat exchanger.

Figure 1A:
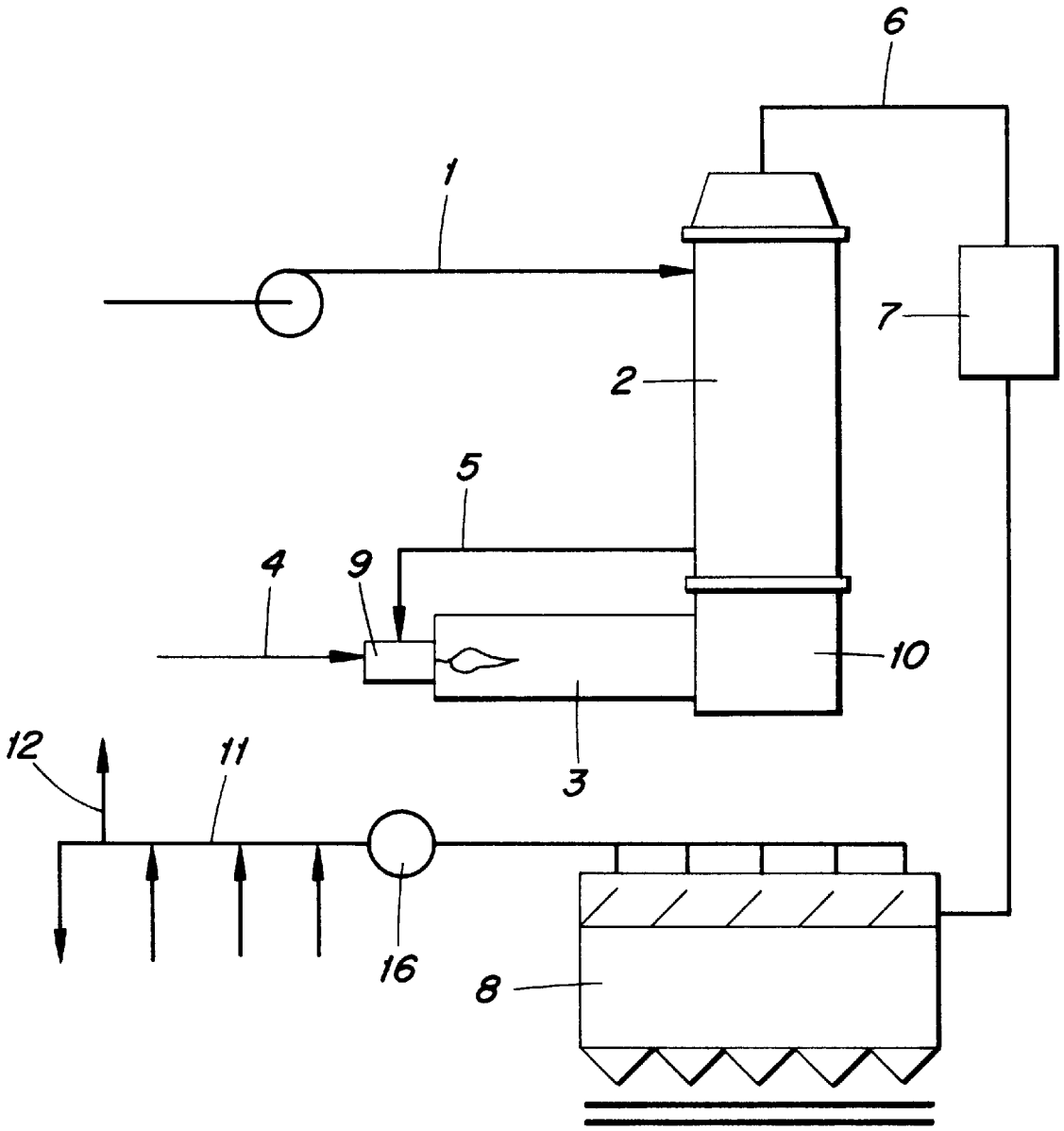
FIG. 1A (PRIOR ART)
FIG. 1A shows a schematic view of a conventional plant for the manufacture of carbon black, such has already been described above.
Figure 1B:
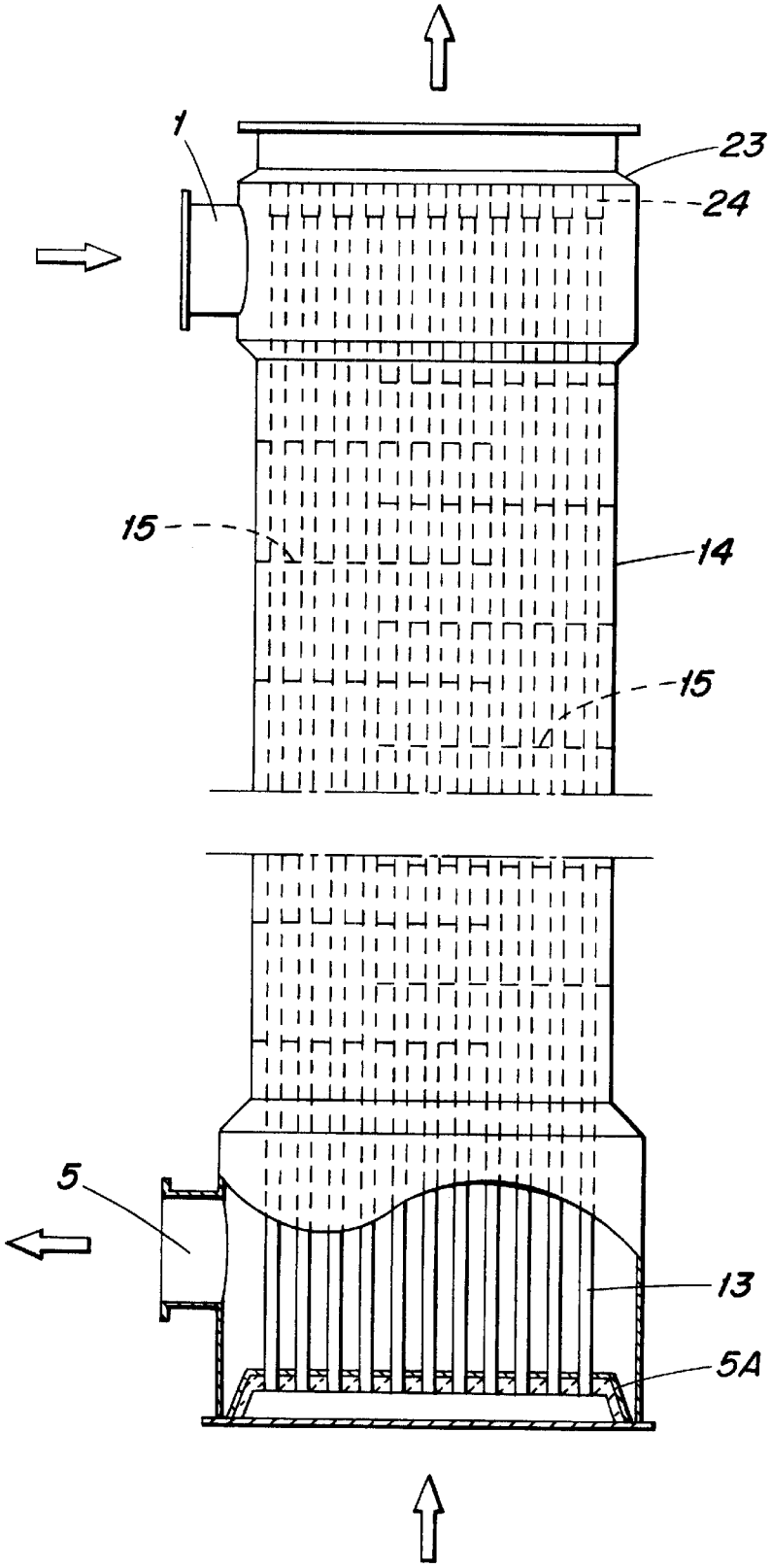
FIG. 1B (PRIOR ART)
FIG. 1B shows a heat exchanger according to the state of the art, such has already been described above.
Figure 2:
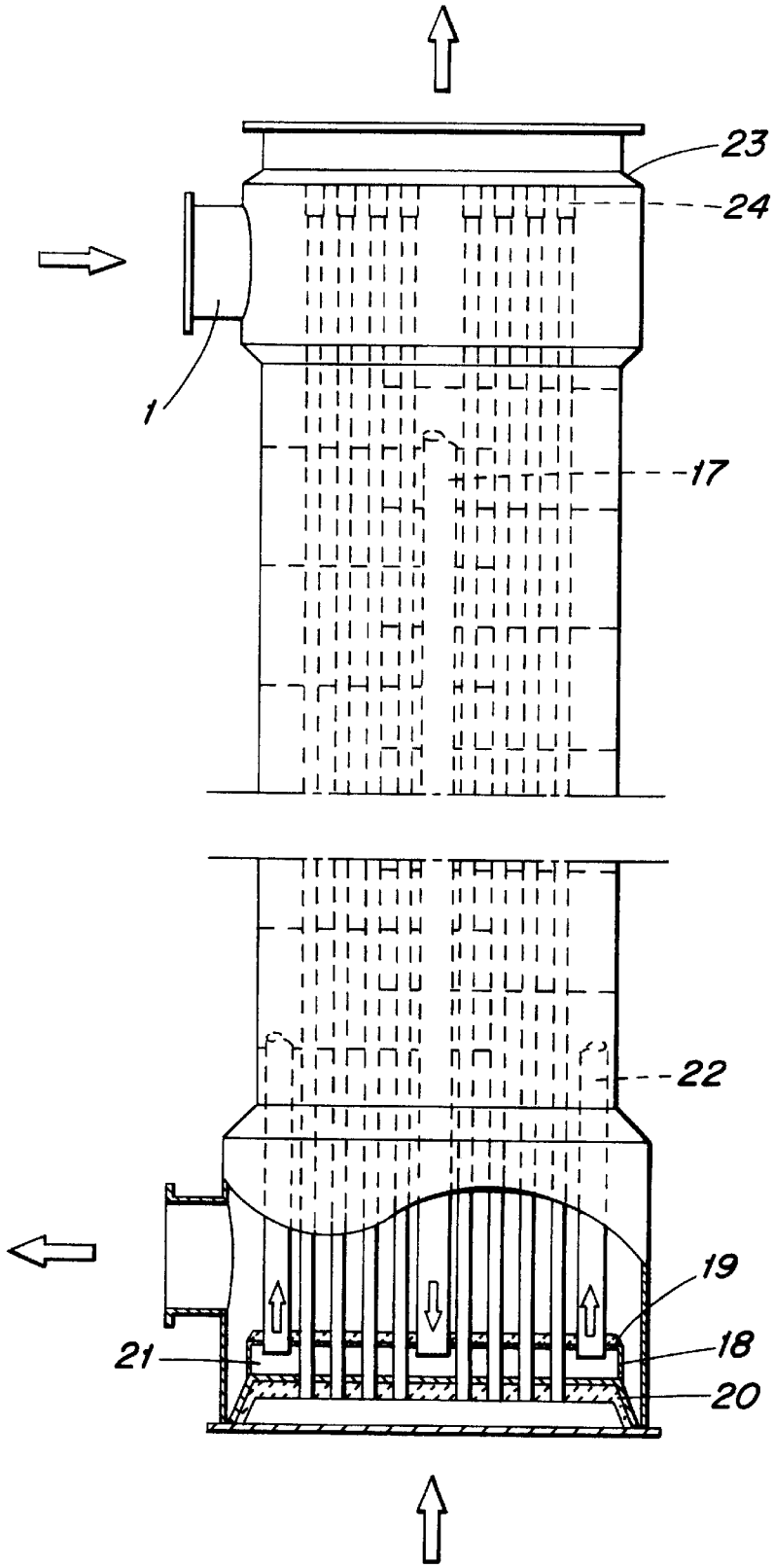
FIG. 2 (PRIOR ART)
FIG. 2 shows a heat exchanger according to the state of the art, such has already been described above.

Such an arrangement would be employed in lieu of an arrangement disclosed in Swedish Patent Applications 9504344-4 and 9603739-5 which were discussed earlier in connection with FIGS. 1–2, wherein the feet of the heat exchanger tubes 13 were securely welded to a tube plate, and upper parts of the tubes extended in collars or compensators disposed at the upper end of the heat exchanger, in order to permit thermal expansions or contractions of the tubes.

That known design has been changed in accordance with the present invention in such a way that the tubes 13 now hang from their upper portions instead of having their lower parts standing on a plate. In order to hang the tubes from their upper portion they are simply welded at the point where they pass through a hole in a horizontal suspension wall 13A which is located at the upper end of the heat exchanger, for example, located at the level of the step 23 in FIG. 1B and/or FIG. 2. The compensators 24 in those figures are replaced by simple welded joints W, whereby the tubes 13 hang down from the wall 13A.

The double-walled tube plate 18A comprises upper and lower walls 19A and 20A. In FIG. 3 the upper wall 19A and the lower wall 20A of the tube plate 18A are depicted. The upper wall 19A comprises a ceramic insulation 25 and a wall 26 of iron or steel plate. The lower wall 20A can comprise refractory ceramic compound 27, an insulating ceramic compound 28 and a steel wall 29. The refractory ceramic material 27 may be required in order to insulate the tube plate 18A from heat radiation emitted by the combustion chamber 10 positioned therebeneath.

The manifold 21 formed between the upper and lower walls 19A, 20A of the tube plate 18A can be sub-divided into a number of channels by ribs in accordance with the Swedish patent application 9603739-5. This is, however, not an important characteristic of the present invention, which relates to the off-loading (i.e. eliminating the loading from) the tube plate. A protective tube or a so called ferrule 30 is provided in the lower part of the tube 13 for conducting the inflow of very hot gases. The ferrules function is to impede the aggressive gases from coming in contact with tube 13 plus, via insulation, to limit the absorption of heat by the tube plate. An intermediate insulation 31, made for example from ceramic blanketing, provides insulation between this ferrule 30 and tube 13. In order to create space for this insulation 31, the inner diameter of the ferrule is largest at its opposite ends and then gradually narrows to a smaller diameter.

A fitting ring 42 is welded in place along the exterior of the upper end of the ferrule, partly for press fitting of the ferrule in the tube, and partly in order to secure the insulation 31 in place. In order to facilitate welding of ferrule 30 in tube 13, a welding ring 43 is provided next to the lower end of the tube. Furthermore a protecting sleeve 32 is provided outside the tube 13, and a further insulation 33, preferably a ceramic blanket, is provided between the protective sleeve 32 and the tube 13. The protecting sleeve 32 is welded at its lower foot to the tube 13, while at the top it quite simply rests against the tube 13. The insulation 33 is thereby enclosed. At the top of the sleeve, a conical part 34 is welded to the outside of the protective sleeve 32, the said part 34 transforming into a cylindrical part 35 which has a larger diameter than that of the protective sleeve 32. Radially outside the protective sleeve 32, and substantially concentric to it, an outer sleeve 37 is provided.

This outer sleeve 37 is fixed, at its top, in the wall of the upper support 26 and is welded to the steel wall 29 at a distance above its bottom edge. An end cap 38 is fastened to the lower edge of the outer sleeve 37. This end cap 38 can have a number of outwardly projecting flaps, for example three in total, which are bent up and over the lower edge of the outer sleeve 37 and then welded to the outside of the outer sleeve, while the end cap 38 otherwise only lies in abutment against the lower edge of the outer sleeve.

A locking ring 36, with a mainly L-shaped cross section is welded in proximity to the lower part of the interior of the outer sleeve 37. The ring shaped space which is defined by the locking ring 36, protective sleeve 32, the outer sleeve 37 and the end cap 38 is occupied by one or two sealing rings 39*a*, 39*b*. These sealing rings can be made of ceramic blanketing, ceramic rope or such like.

Figure 4:
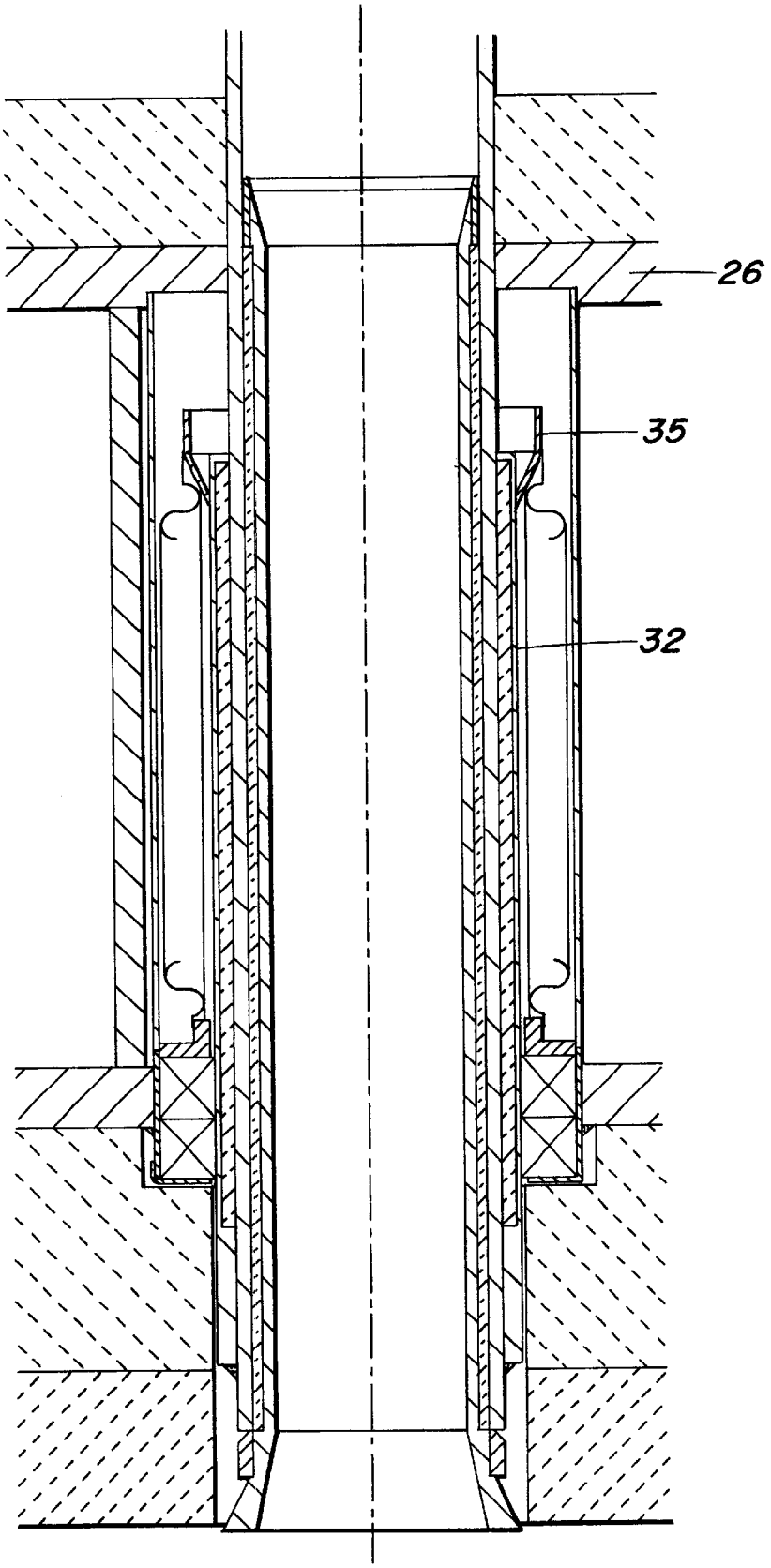
FIG. 4 shows the same section as in FIG. 3 but in an another embodiment.

A compensating bellows 40 is provided in the cylindrical chamber formed between the protective sleeve 32 and the outer sleeve 37, which bellows is welded gas-tight at its top in the transition area between the conical part 34 and the upper cylindrical end part 35 of the protective sleeve. At its foot, the bellows is gas-tight welded to the locking ring 36. Because the bellows can retract and expand, the tube 13 is allowed to expand and contract because of variations in the temperature. In the situation illustrated in FIG. 3, the cylindrical upper end part of the sleeve 32 abuts against the upper tube plate wall 26, so the tube 13 will exhibit a relatively lower temperature. In a modified arrangement illustrated in FIG. 4, the protective upper cylindrical end part of the sleeve 32 is distanced from the wall 26, so the tube 13 will exhibit a relatively higher temperature compared with the situation in FIG. 3.

By suspending the heat exchanger tubes from the support wall 13A, the risk that the tubes will bend or deform because of the load from the weight of the tubes themselves is eliminated. As a result of the design of the bellows described in FIGS. 3 and 4, the pipes can thermally expand and contract freely. Bearing in mind that the tubes are often 13–15 m long, it can be easily understood that these expansions and contractions can be very significant and can be on the order of up to 5 cm.

An additional advantage has also been achieved as a result of this invention. In conventional heat exchangers wherein the tubes stand on a tube plate, it has been necessary to provide the tubes with greater wall thicknesses at their lower region, in order to increase the resistance to bending and buckling. Thus for example a 13 m long tube has been manufactured with 3 mm wall thickness in the upper 9 m extent, and 5 mm thick walls in the lower 4 m extent. Because of the invention described herein, it is possible to dispense with the lower, thicker wall thickness and hence the tube can be manufactured with for example 3 mm wall thickness along its entire length.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A heat exchanger comprising:

a substantially cylindrical, closed vessel defining a first space;

a horizontal support wall disposed within the first space adjacent an upper portion thereof;

a plurality of tubes fully connected to the support wall by a weld and hanging downwardly therefrom within the first space;

a tube plate situated adjacent a lower portion of the first space, the tube plate including upper and lower walls spaced vertically apart to form a second space, a cooling manifold disposed in the second space for conducting cooling medium, the tubes extending downwardly through the upper and lower walls;

a plurality of metallic bellows disposed around respective tubes, each bellows extending between the respective tube and the tube plate, one end of each bellows affixed for movement with a respective tube by a weld, the bellows being compressible and expandible to accommodate thermal expansion and contraction of the tubes; and a plurality of outer sleeves arranged in surrounding relationship to respective bellows, each sleeve extending from the upper wall to the lower wall.

2. The heat exchanger according to claim 1 wherein a protective sleeve surrounds a lower part of each tube, the bellows disposed in a chamber formed radially between the protective sleeve and the outer sleeve.

3. The heat exchanger according to claim 1, further including a protective sleeve welded to each tube and surrounding a portion of the tube extending through the second space, the protective sleeve being welded to one end of a respective bellows, and a layer of thermal insulation disposed between each tube and its respective protective sleeve.

* * * * *